US005715273A

United States Patent [19]

Dratner et al.

[11] Patent Number: 5,715,273

[45] Date of Patent: Feb. 3, 1998

[54] SECONDARY CIRCUIT WITH VARIABLE IMPEDANCE FOR ELECTRIC ARC FURNACES

[75] Inventors: Johannes Dratner, Castrop-Rauxel, Germany; Gianni Gensini, Buia; Daniele Merlino, Moruzzo Fraz. Brazzacco, both of Italy

[73] Assignee: Danieli & C. Officine Meccaniche SpA, Buttrio, Italy

[21] Appl. No.: 633,308

[22] Filed: Apr. 15, 1996

[30] Foreign Application Priority Data

Apr. 14, 1995 [IT] Italy ..... UD95A0069

[51] Int. Cl.[6] ..... H05B 7/11

[52] U.S. Cl. ..... 373/103; 373/93; 373/105

[58] Field of Search ..... 373/9, 103, 105, 373/93

[56] References Cited

U.S. PATENT DOCUMENTS

| | | | |
|---|---|---|---|
| 2,368,998 | 2/1945 | Nissim | 373/103 |
| 3,366,725 | 1/1968 | Watterson | 373/103 |
| 3,431,344 | 3/1969 | Borrebach | 373/105 |
| 3,483,300 | 12/1969 | McGee | 373/103 |
| 3,835,232 | 9/1974 | Marchner | 373/81 |
| 3,898,707 | 8/1975 | Trageser | 373/103 |
| 4,425,658 | 1/1984 | Bretthauer et al. | 373/103 |

FOREIGN PATENT DOCUMENTS

| | | |
|---|---|---|
| 1569521 | 5/1969 | France . |
| 2258075 | 8/1975 | France . |
| 3808683 | 9/1989 | Germany . |
| 3814261 | 11/1989 | Germany . |

*Primary Examiner*—Tu B. Hoang

*Attorney, Agent, or Firm*—Antonelli, Terry, Stout & Kraus, LLP

[57] ABSTRACT

A secondary circuit having a variable impedance for electric arc furnaces of a type working with alternating current, which is associated with a transformer (11) is disclosed. A secondary circuit comprises at least one rigid connection (12) connected to the outputs (16) of the transformer (11), flexible cables (13) connected through rigid connection elements (29, 129) at first end to the rigid connection (12) and at the other end to specific electrodes (15). At least one branch of the secondary circuit (10) corresponds to a specific phase including at least one of the respective rigid components (12, 17, 29, 129) having at least two parts reciprocally positionable in an adjustable manner according to the required value of overall reactance of the specific branch of the secondary circuit (10) comprising that rigid component (12, 17, 29, 129).

9 Claims, 2 Drawing Sheets

SECONDARY CIRCUIT WITH VARIABLE IMPEDANCE FOR ELECTRIC ARC FURNACES

BACKGROUND OF THE INVENTION

This invention concerns a secondary circuit with variable impedance for electric arc furnaces.

FIELD OF THE INVENTION

The invention is used in the field of electric arc furnaces working with alternating current so as to make possible a required variation of the geometry of the secondary supply circuit of the furnace for the purpose of making variable, and therefore adjustable as desired, the impedance of each of the phases independently of each other.

This invention accomplishes this adjustment without having recourse to additional auxiliary elements such as immovable or movable coils or other means.

DESCRIPTION OF THE PRIOR ART

The state of the art covers the problems linked to the secondary circuits of electric arc furnaces working with alternating current.

Furnaces fed with alternating current which are most often used have a three-phase supply, as generally referred to as follows. However the invention is applied in the same way to furnaces which have only two separate phases.

It is known that the secondary supply circuit of a furnace is that part of the circuit which runs from the furnace transformer to the electric arc.

This part comprises:

- a stationary connection between the transformer and the flexible cables, this connection being rigid and generally connected to the foundations;
- flexible cables which connect the stationary connection together with the transformer to the electrode-holder arms and which enable those arms to be moved vertically to alter the vertical position of the electrodes in relation to the furnace;
- the electrode-holder arms, of which there is one per each phase and which consist generally of a rigid cross bar which can be moved at least vertically by suitable actuation systems and bears at its ends, on one side, the connection to the flexible cables and, on the other side, the clamps to clamp the relative electrode;
- the electrodes, which generally consist of graphite and can be consumed, and between which the electric arc burns.

It is known that in polyphase electric furnaces it is necessary to have a secondary circuit which is correctly balanced as much as possible, that is to say, a circuit having a substantially equal impedance in all the phases so as to have the same electric power passing through and therefore so as not to have imbalances in the circulating currents.

An imbalance of current as between the various phases of the secondary circuit causes problems of overheating and of creation of hot points in the furnace with resulting effects on the quality and efficiency of the melting process owing to a non-symmetrical distribution of the electric arc.

The higher the circulating current is, the more important is this problem.

In particular, there may occur the so-called phenomenon of the "wild phase" whereby one of the outer phases, if there is an imbalance in the reactances, is overloaded whereas the other outer phase is discharged; this leads not only to other shortcomings regarding the quality and efficiency of the melting but also to speedy wear of the refractory positioned on the side of the overloaded phase.

In order to avoid imbalance in the phases, the balancing of the reactances, moreover, cannot be based on adjustment of the vertical height of the electrode-holder arms, as happens in operation when there is molten steel, since the arms during working have to be positioned as much as possible at the same height and the electrodes have to have the same length to prevent imbalances occurring in the electrical working characteristics of the furnace.

In fact, these imbalances have a direct unfavourable effect on the method of working of the electric arc, which has to be stable and have the same length for each of the phases.

For these reasons a balance of impedance in the individual phases has to be attained, keeping all the arms at the same height.

So as to achieve this, an accurate design of the elements of the secondary circuit is necessary.

However, for various reasons among which can be cited inaccuracies in calculations, manufacturing and/or installation tolerances of the components, and movements of the cables during the working, an imbalance in the phases often takes place just the same.

In this case it is no longer possible to take corrective action without modifying the geometry of some element in the rigid part or without introducing a further auxiliary element such as a coil for instance, as disclosed in DE-A-3.516.940 for example.

Such corrective action, however, is very expensive, entails long downtimes and may not give fully satisfactory results.

SUMMARY OF THE INVENTION

The present applicants overcomes these shortcomings, which have been the subject of complaints by manufacturers in this field for a long time, and achieves further advantages.

The purpose of the invention is to provide in an electric furnace a secondary circuit configured in such a way as to provide, without using auxiliary elements, an impedance which can be adjusted independently for each of the single supply phases.

This adjustment of the single phases has the purpose of balancing the reactances in each of the phases and of compensating for any inaccuracies of design, construction and/or installation as well as imbalances arising from movements during the working.

As is known, in the terminology conventionally used when reference is made to alternating electrical magnitudes, the reactance forms the imaginary part of the impedance.

The secondary circuit to which this invention is applied comprises conventionally a rigid connection, which connects the output of the transformer to the electrode-holder arms, which also are rigid, through flexible cables which make possible the desired vertical movement of the electrodes.

According to the invention at least one of the rigid parts of the secondary circuit, for instance the rigid connection between the transformer and the flexible cables and/or the electrode-holder arms, is embodied with at least two reciprocably movable parts connected to each other by a connection element which can be adjustably positioned.

This makes it possible to alter in a desired manner, for each of the phases, the geometry of at least a part of the secondary circuit and thus to alter the relative impedance, by increasing or reducing it by a desired value.

The specific variation of the impedance in an independent manner for each of the phases makes possible the correction of any imbalances of the reactances as between the phases; these imbalances may be due to mistakes in the designing, construction and/or installation of one or more of the rigid components forming the secondary circuit, and/or to the uncontrolled movements of the flexible cables during working.

According to another embodiment, which can be embodied independently or in combination with the solution described above, the rigid elements connecting the flexible cables to the respective rigid parts, whether those elements are the rigid connection or the electrode-holder arms or both, are made movable with adjustable positioning according to the desired value of overall impedance of the phase in question of the secondary circuit.

This solution also makes possible the compensation of imbalances of reactance for each of the phases and enables a condition of substantial equality to be achieved, or at least approached, between the impedances in each branch of the secondary circuit of the furnace.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
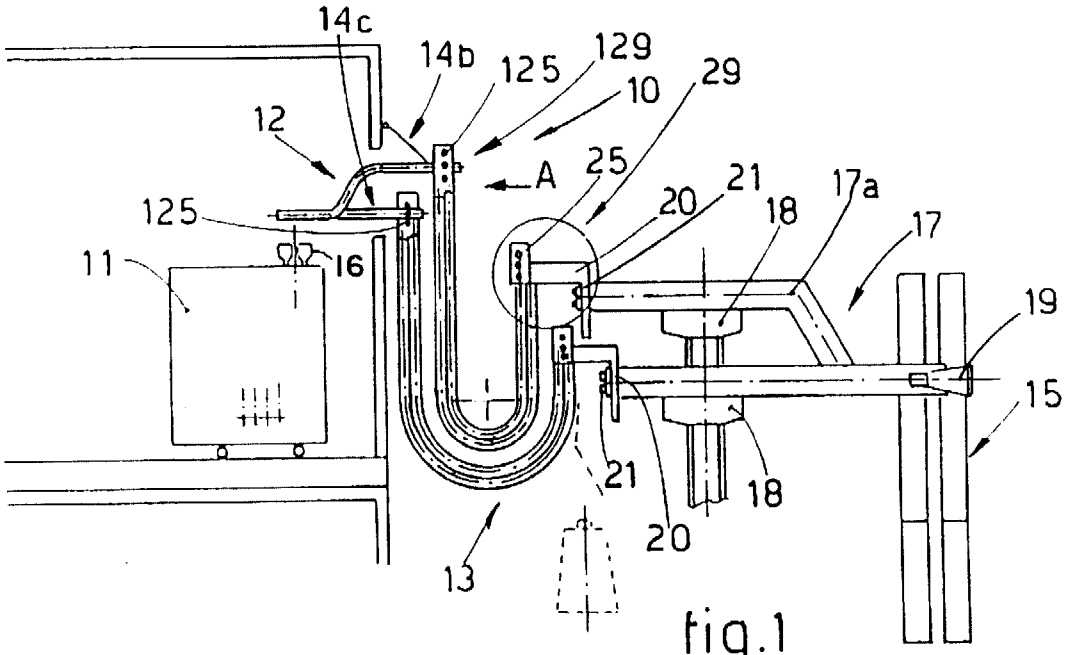
FIG. 1 is a diagram of a side view of a possible secondary supply circuit of a three-phase electric arc furnace.
Figure 2:
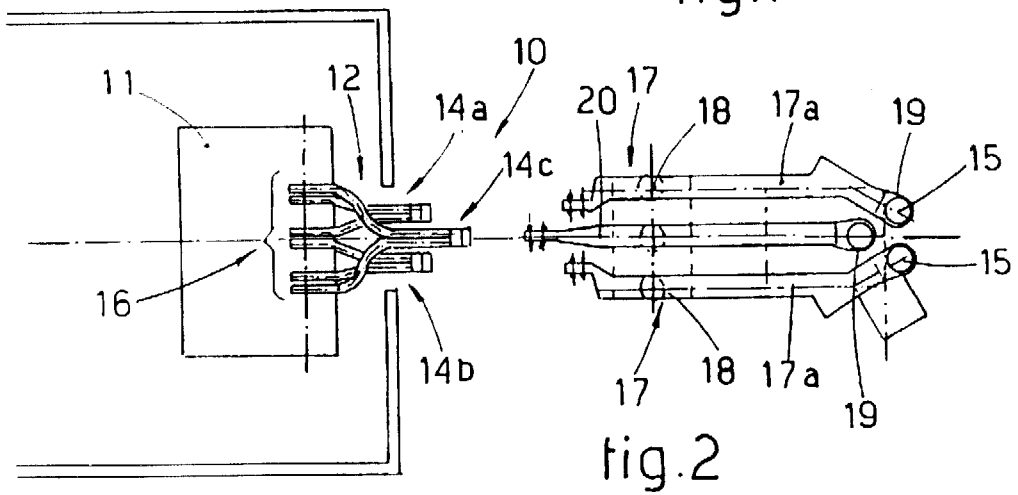
FIG. 2 is a plan view of the secondary circuit of FIG. 1.

A secondary circuit 10 of a three-phase electric furnace is shown diagrammatically in FIGS. 1 and 2 and comprises, as essential parts, a transformer 11, a rigid connection 12 conformed in this case with a delta-closure, flexible cables 13, electrode-holder arms 17 and electrodes 15.

Figure 3:
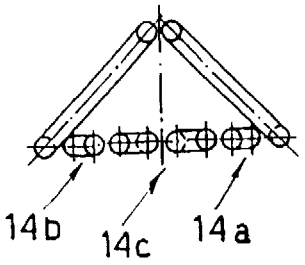
FIG. 3 is a view according to the arrow A of FIG. 1.

The rigid connection 12 (FIGS. 2 and 3) consists of pairs of conductors, made of copper, for instance, or another suitable conductive material and having any form of cross-section, which connect the specific outputs referenced generically with 16 of the transformer 11 to the respective flexible cables 13.

The conductors **14*a* and 14*b* are the outer phases and the conductor 14*c*** is the central phase.

The electrode-holder arms 17 cooperate with vertical actuation means 18 of the state of the art and comprise at their ends clamps 19 to clamp the electrodes 15.

At least one layer of electrical insulation material 28 is included between the vertical actuation means 18 and the relative electrode-holder arm 17.

According to the invention at least the electrode-holder arm 17 of each single phase are made of at least two parts which can be reciprocally positioned adjustably and each of which together with the relative reciprocal positioning and adjustment elements forms an assembled electrode-holder arm 17.

Figure 4:
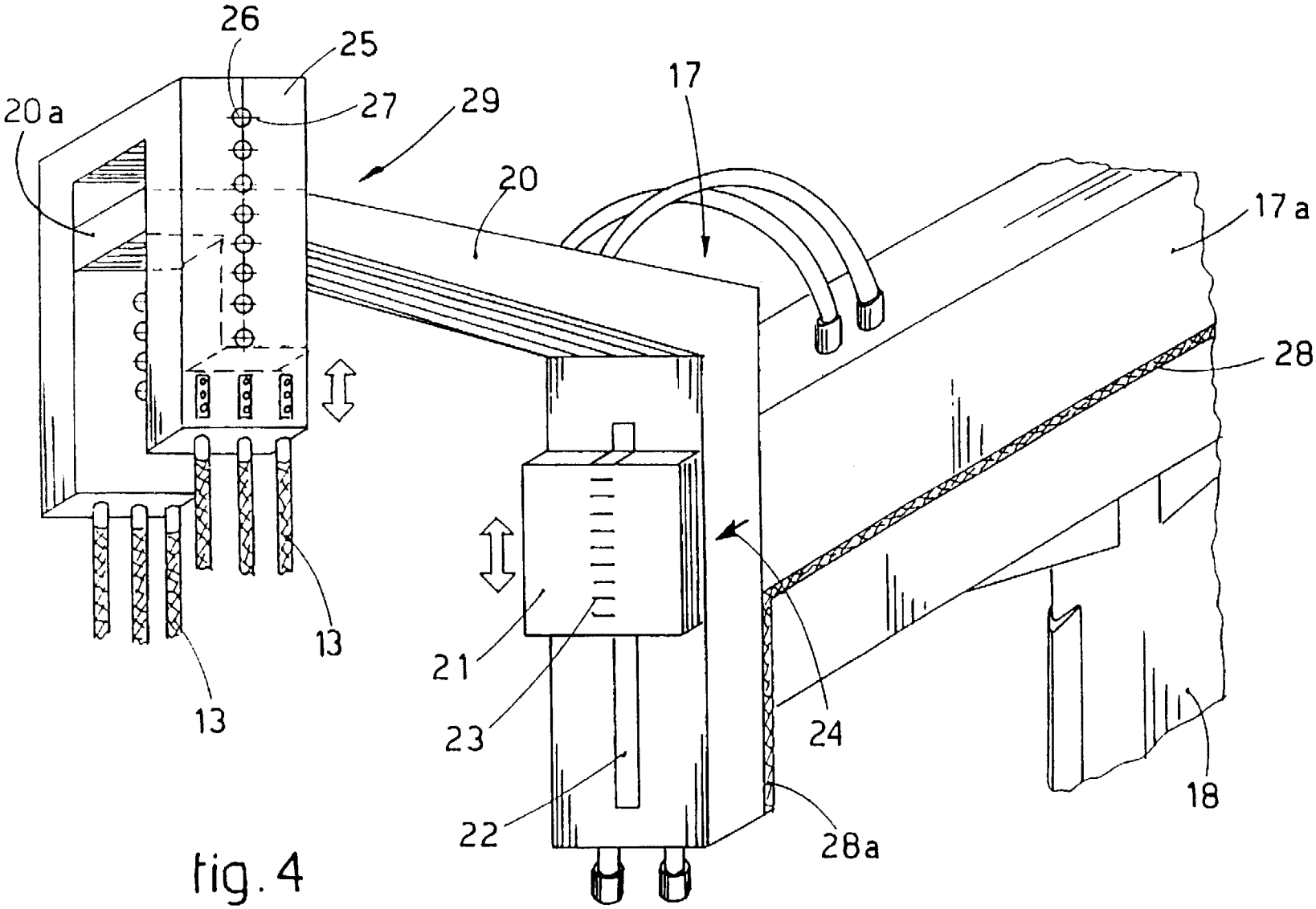
FIG. 4 shows the detail B of FIG. 1 in an enlarged scale.

FIG. 4 shows as an example a possible form of embodiment of one of the electrode-holder arms 17; this embodiment can be applied in the same way to the electrode-holder arms 17 of the other phases.

In this case the connection between the flexible cables 13 and the relative electrode-holder arm 17 is obtained with a movable connection 20 which is connected to the relative stationary part **17*a* of the electrode-holder arm 17 by means of a fixture plate 21**.

In other words, the electrode-holder arm 17 includes a stationary part **17*a* having the task of supporting the electrodes 15 and a movable part 20 which can be displaced in relation to the stationary part 17*a***.

According to the invention the layer 28 of insulation material extends to a vertical section at **28*a* an intermediate position between the vertical actuation means 18 and the movable connection 20**.

The stationary part **17*a* of the electrode-holder arm 17 is the part which bears terminally the clamps 19 holding the electrodes 15; this part 17*a* therefore has to remain stationary so as not to alter the relative position of the electrodes 15 for the reasons given above, except when that position is changed, for instance during the working cycle of the furnace, by the action of the vertical actuation means 18**.

The fixture plate 21 is associated advantageously with the relative stationary part **17*a* of the electrode-holder arm 17** by means of a connection which can be dismantled.

The fixture plate 21 can slide vertically along a guide 22, thus enabling the movable connection 20 to be displaced upwards or downwards by a required value in relation to the stationary part **17*a* to change the electrical path length of current flow between the transformer 11 and the electrodes 15** which changes the total reactance of the electrical path.

The movable connection 20 thus performs a function analogous to a rheostat, and its alterations of position in relation to the stationary part **17*a* of the electrode-holder arm 17 alter in a desired manner the reactance of the circuit which runs from the transformer 11 to the stationary part 17*a* and to the electrode 18** by changing the electrical path length.

The fixture plate 21 advantageously bears a first graduated scale 23 representing variation of the electrical path length and total reactance, which in cooperation with an indicator 24 associates with the relative position of the movable connection 20 in relation to the stationary part **17*a*** the corresponding value of overall reactance, and therefore of impedance, of the circuit.

According to a variant of the invention shown in detail in FIG. 4 the overall impedance of the secondary circuit 10 can also be altered by changing the geometry of the connection 29 between the flexible cables 13 and the electrode-holder arm 17 at the opposite end of the movable connection 20 which again varies the electrical path length of current flow between the transformer 11 and the electrodes 15 which changes the total reactance of the electrical path.

In this case the connection 29 forms a rigid component of the secondary circuit 10 and consists of at least two parts which can be reciprocally positioned.

In this example the connection 29 consists of a connecting plate 25 connected to the end **20*a* of the movable connection 20, whereby the connecting plate 25 can be displaced and forms the movable part of the connection 29, whereas the movable connection 20 forms the stationary part of the connection 29**.

The connecting plate 25 enables the geometry of this connection 29 of the flexible cables 13 to be altered, thus making variable the reactance of the circuit in a corresponding manner.

In this case also the various points of anchorage 26 between the displaceable connecting plate 25 and the movable connection 20 can be associated with a second graduated scale 27 representing variation in electrical path length and total reactance indicating the value of reactance associated with the position in question.

According to an another embodiment of the invention (FIG. 1) connecting plates 125 are provided which can be displaced at the connection 129 between the other end of the flexible cables 13 and the rigid connection 12.

According to a further embodiment, which is not shown here, a connection of the movable connection type 20 shown in FIG. 4 is provided at the rigid connection 12.

We claim:

1. A multiple phase secondary circuit for an electric arc furnace with each phase having a variable impedance which operates with alternating current and is associated with a transformer having outputs comprising:

each phase comprising a branch having at least one rigid connection connected to the outputs of the transformer, flexible cables connected through rigid connection elements at a first end thereof to the at least one rigid connection and at another end thereof to electrode-holder arms holding electrodes, each branch including at least two parts disposed in the secondary circuit between the electrodes and the flexible cables and each branch being reciprocally positionable in an adjustable manner to assume different fixed relative positions of the at least two parts to provide a variable electrical path length for the flow of electrical circuit in the secondary current between the transformer and the electrodes for providing a required and variable value of reactance.

2. A secondary circuit as recited in claim 1 wherein:

the electrical path length of each branch is adjustable independently in relation to a corresponding electrical path length of each other branch.

3. A secondary circuit as recited in claim 1 wherein:

each electrode holder arm comprises a stationary part and a movable part, the moveable part when moved changes an electrical path length of current flow between the transformer and the electrodes and is adjustably positionable in relation to the stationary part.

4. A secondary circuit as recited in claim 3 wherein each electrode holder arm further comprises:

means to identify a value of the reactance according to a position of the movable part in relation to the stationary part.

5. A secondary circuit in accordance with claim 3, wherein:

the moveable part is attached to the stationary part with a connection.

6. A secondary circuit in accordance with claim 5, wherein:

the connection is a connection plate with the connection plate and the stationary part having an identification of a value of reactance according to a position of the connection plate relative to the moveable part.

7. A secondary circuit as recited in claim 1, wherein each branch includes at least two pairs of the parts and is reciprocally positionable in the adjustable manner.

8. A secondary circuit as recited in claim 7, wherein:

the electrode holder arm of each branch comprises a first pair of the two pairs of parts with a first part of the electrode holder arm being stationary and a second part of the electrode holder arm being moveable which when moved changes the electrical path length between the transformer and the electrodes and is path length between the transformer and the electrodes and is adjustably positionable in relation to the stationary part; and a second part of the two pairs of parts of each branch comprises a connection disposed between the moveable part of the electrical holder arm of the branch and the flexible cables of the branch with a point of the connection being disposed between the moveable part of the electrode holder arm and the flexible cables and being moveable to vary the electrical path length of current flow between the transformer and the electrodes.

9. A secondary circuit as recited in claim 8, wherein:

the connection comprises a connection member to which the flexible cables are attached and the point of connection is selected from a plurality of connection points disposed along the connection member and is attached to the second part of the electrode-holder arm.

* * * * *